US005318206A

United States Patent [19]

Maas et al.

[11] Patent Number: 5,318,206

[45] Date of Patent: Jun. 7, 1994

[54] TRIGGER-PISTON CONNECTION

[75] Inventors: Wilhelmus J. J. Maas; Petrus L. S. Hurkmans, both of Someren, Netherlands

[73] Assignee: AFA Products, Inc., Forest City, N.C.

[21] Appl. No.: 840,760

[22] Filed: Feb. 24, 1992

[51] Int. Cl.[5] ..... B67D 5/42

[52] U.S. Cl. ..... 222/383; 222/340

[58] Field of Search ..... 239/333; 222/340, 341, 222/380, 382, 383

[56] References Cited

U.S. PATENT DOCUMENTS

| | | | |
|---|---|---|---|
| 3,061,202 | 10/1962 | Tyler | 239/333 |
| 3,768,734 | 10/1973 | Anderson, Jr. et al. | 222/341 X |
| 3,780,951 | 12/1973 | Powers | 222/383 X |
| 4,061,250 | 12/1977 | Tada | 239/333 X |
| 4,365,751 | 12/1982 | Saito et al. | 239/333 |
| 4,480,768 | 11/1984 | Martin | 222/341 |
| 4,606,480 | 8/1986 | Gazulla | 222/341 |
| 4,624,413 | 11/1986 | Corsette | 239/333 |
| 4,815,663 | 3/1989 | Tada | 222/383 X |
| 5,152,461 | 10/1992 | Proctor | 239/333 X |
| 5,169,032 | 12/1992 | Steijns et al. | 222/383 X |

FOREIGN PATENT DOCUMENTS

| | | | |
|---|---|---|---|
| 3314021 | 10/1984 | Fed. Rep. of Germany | 239/333 |

*Primary Examiner*—Andres Kashnikow
*Assistant Examiner*—Kenneth Bomberg
*Attorney, Agent, or Firm*—Thomas R. Vigil

[57] ABSTRACT

The trigger operated pumping mechanism for a fluid dispensing device comprises a body and the pumping mechanism comprises a cylinder in the body of the dispensing device, a piston received in the cylinder and having a piston rod extending outwardly therefrom to an outer end and a trigger movably mounted to the body and having a front side and a back side. A first coupling structure is provided on the outer end of the piston rod for coupling to the trigger. A second coupling structure is provided on the back side of the trigger for releasably coupling to the first coupling structure on the piston rod in a snap-fitting manner and a spring is provided outside of the cylinder for biasing the trigger away from the body.

8 Claims, 5 Drawing Sheets

TRIGGER-PISTON CONNECTION

BACKGROUND OF THE INVENTION

1. Field of the Invention

The present invention relates to a trigger operated dispensing device, e.g. a trigger sprayer, for mounting on a storage container. The trigger sprayer includes a pumping mechanism having a trigger, a piston and a pumping chamber for pumping a desired amount of liquid out of the storage container and wherein the trigger is releasably coupled to the piston.

The pumping mechanism operates in two working strokes: a fluid intake stroke and a fluid ejection stroke. The fluid intake stroke sucks liquid out of the container into the pumping chamber. The fluid ejection stroke discharges the fluid from the pumping chamber through a nozzle assembly of the trigger sprayer into the atmosphere. The fluid ejection stroke is carried out by the operator squeezing the trigger and the fluid intake stroke is carried out by a biasing mechanism, such as a spring or spring assembly, of the pumping mechanism.

More specifically, the present invention relates to a trigger-piston connection wherein the trigger and the piston are detachably and movably connected to each other.

2. Description Of The Related Art Including Information Disclosed Under 37 CFR 1.97–1.99

Heretofore, various trigger sprayers have been proposed.

Three examples of previously proposed trigger sprayers having a trigger-piston connection are disclosed in the following patents:

| U.S. Pat. No. | Patentee |
|---|---|
| 3,061,202 | Tyler |
| 4,606,480 | Gazulla |
| 4,624,413 | Corsette |

The Tyler U.S. Pat. No. 3,061,202 discloses a V-shaped notch or crotch at the outer end of a spring biased piston received in a cylinder in a trigger sprayer. A rounded edge of a cross web in a trigger is received in the notch and moves between the sides of the notch as the trigger is squeezed.

The Gazulla U.S. Pat. No. 4,606,480 discloses a trigger sprayer which uses a vertical pumping system and wherein a trigger is provided with a laterally (horizontally) extending cylindrical shaft which is pressed into a concave molding having an arc greater than a half circle. As the trigger is squeezed, two arms, disposed forkwise and each having a curved end surface, engage and push upwardly a tubular piston.

The Corsette U.S. Pat. No. 4,624,413 discloses a trigger sprayer wherein a piston has an outwardly open central bore which is undercut for snap fitting engagement with a piston rod 30 having a head configured for snap fitting engagement with the undercut of the bore. The piston rod is integrally connected through a web or hinge with a trigger hingedly connected to the body of the trigger sprayer. The web or hinge will bend as the trigger is squeezed.

SUMMARY OF THE INVENTION

According to the invention there is provided a trigger operated pumping mechanism for a fluid dispensing device comprising a body. The pumping mechanism comprises a cylinder in the body of the dispensing device, a piston received in the cylinder and having a piston rod extending outwardly therefrom to an outer end and a trigger movably mounted to the body and having a front side and a back side. A first coupling structure is provided on the outer end of the piston rod for coupling to the trigger. A second coupling structure is provided on the back side of the trigger for releasably coupling to the first coupling structure on the piston rod in a snap-fitting manner and a spring is provided outside of the cylinder for biasing the trigger away from the body.

DESCRIPTION OF THE PREFERRED EMBODIMENT(S)

Figure 1:
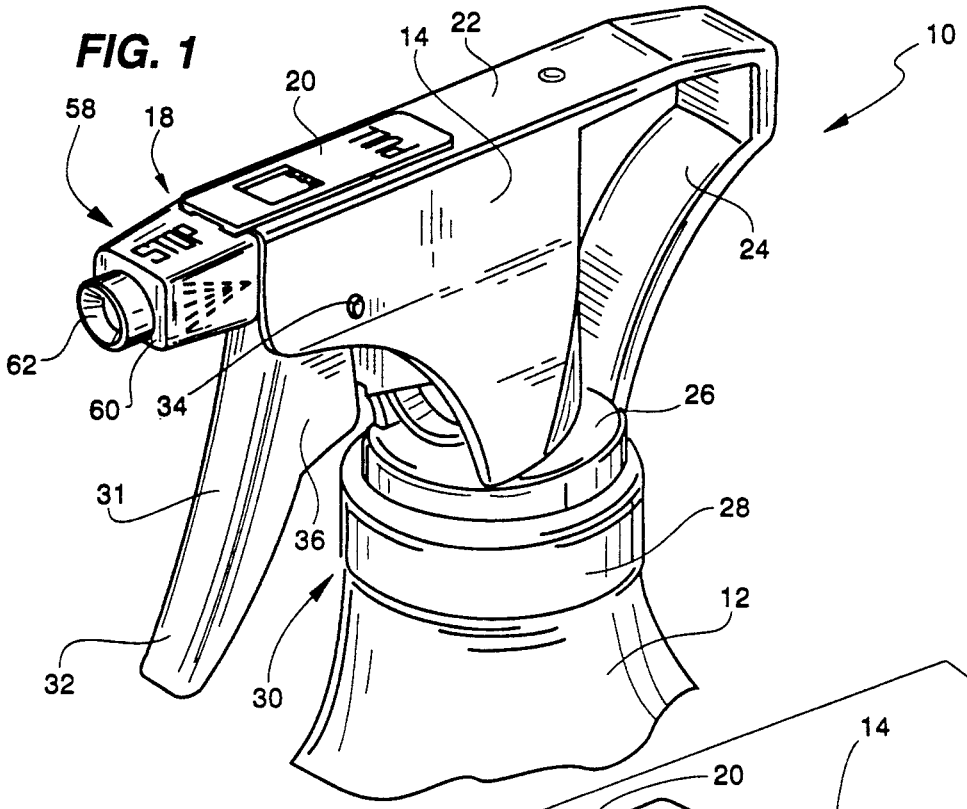
FIG. 1 is a perspective view of a trigger sprayer constructed according to the teachings of the present invention.

Referring now to the drawings in greater detail, there is illustrated in FIG. 1 a perspective view of an all synthetic/plastic trigger sprayer 10 coupled to a bottle 12.

Figure 2:
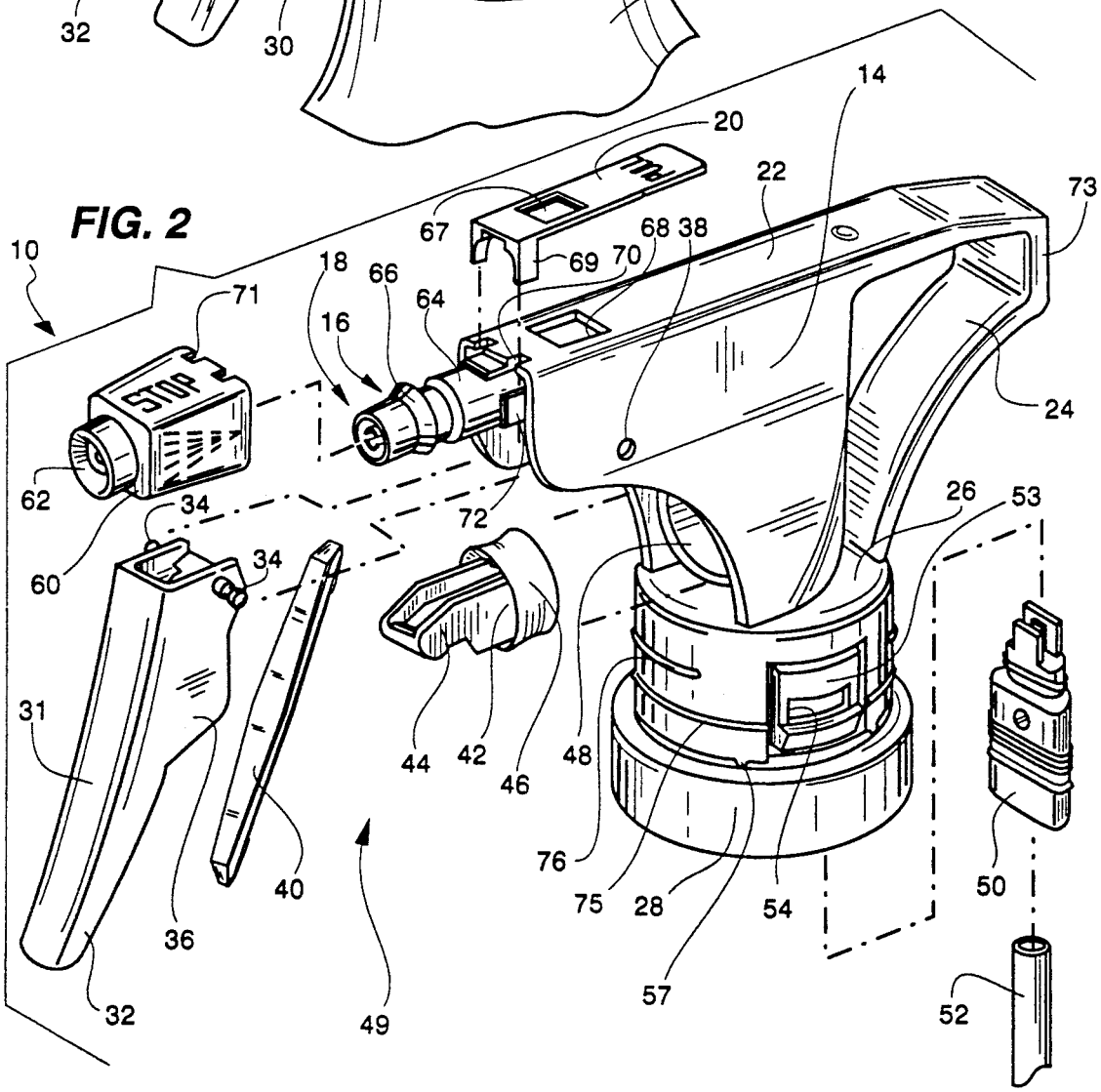
FIG. 2 is an exploded perspective view of the trigger sprayer shown in FIG. 1 and shows a locking ring prior to its detachment from a cylindrical base of the sprayer body.

An exploded perspective view of the parts of the trigger sprayer 10 is shown in more detail in FIG. 2.

The trigger sprayer 10 includes a body 14, a nose bushing 16 at a discharge end 18 of the body 14, a nozzle tamper proof pull away piece 20, a top portion 22 and a hand gripping formation 24 extending rearwardly from the top portion 22 of the body 14 and then downwardly to a cylindrical base 26 of the body 14. The base 26 is held by a locking ring 28 to a neck 30 of the bottle 12.

A trigger 32 having a front side 31 is pivotally mounted to the body 14 by having two cylindrical pins 34, molded on the top end of two opposed side walls 36 of the trigger 32, inserted into two corresponding holes 38 in the body 14 of the trigger sprayer 10.

As shown in FIG. 2, a plastic spring assembly 40 is placed between the body 14 and the trigger 32 to urge the trigger 32 always back into its home position. Coupled to the trigger 32 is a piston 42 having an outer piston rod 44 which connects with the trigger 32 and an inner cylindrical end 46 which is received in a cylindrical opening 48 in the body 14 for the purpose of varying the volume in a pumping chamber defined in the opening 48.

The trigger 32, the spring assembly 40, the piston 42 and the cylindrical opening 48 form and define primary components of a pumping mechanism 49.

A valve intake stem 50 is received into the bottom of the cylindrical base 26 and has a dip tube 52 releasably fixed thereto and depending therefrom for insertion into the bottle 12.

A safe and child resistant sprayer/bottle connection is provided and includes locking tabs 53 with lug receiving openings 54 formed in the cylindrical side wall of the cylindrical base 26 and locking lugs on the bottle neck 30 and locked in place by the locking ring 28.

When the molded sprayer body is removed from a mold, the locking ring 28, connected to the cylindrical base 26 of the body 14 by six links, points, fillets or webs 57 which are necessary for molding the locking ring 28 together with the body 14 is broken away from the cylindrical base 26 by breaking the fillets 57 and moved upwardly on the base. During assembly of the parts of the trigger sprayer 10, the locking ring 28 is moved downwardly over the cylindrical base 26.

A nozzle assembly 58 is provided and includes a rotatable nozzle cap 60 having a forwardly extending cylindrical extension 62. The nozzle cap 60 is mounted on the nose bushing 16 extending from a cylindrical portion 64 of the body 14 and includes an annular band 66 for holding the nozzle cap 60.

Three different positions of the nozzle cap 60, a STOP position, a SPRAY position, and a STREAM position are provided.

When the nozzle assembly 58 is mounted to the body 14, a mounting block 67 of the piece 20 is snap fittingly received through an opening 68 in the top portion 22. At the same time, fork arms 69 of the piece 20 extend through notches 70 in the top portion 22 and/or notches 71 in the top wall of the cap 60 between one of two flexible locking legs or prongs 72 and the cylindrical portion 64 for securing the nozzle cap 60 in its STOP position, thereby ensuring a tamper proof and child resistant locking of the trigger sprayer nozzle assembly 58 to the body 14.

The nozzle assembly 58 is mounted on the discharge end 18 of trigger sprayer 10, as described above. The top portion 22 of the body 14 extends rearwardly to a rear end 73 of the hand gripping formation 24 and then slants forwardly and downwardly from the rear end 73 to the cylindrical base 26.

The six contact fillets or webs 57 are uniformly distributed around the lower end of the cylindrical base 26 and are initially integral with the locking ring 28. During the molding process, the contact fillets or webs 57 are broken and the locking ring 28 is moved upwardly relative to the cylindrical base 26. Later, when the locking ring 28 is moved downwardly on the base 26, an annular groove 74 within the locking ring 28 snap-fittingly mates with an annular rib 75 on the base 26. The upper position of the locking ring 28 is the pre-application-to-a-bottle position and the locking ring 28 is held in this position by frictional engagement of the inner wall of the locking ring 28 with the rib segments 76 provided on the outer cylindrical wall of the cylindrical base 26. The upper, partially annular rib segments 76 on the outer cylindrical wall of the cylindrical base 26 locate and to some extent limit upward movement of the locking ring 28.

The piston-trigger connection with its pivotally coupled trigger 32 is illustrated in more detail in FIGS. 3–10.

Figure 3:
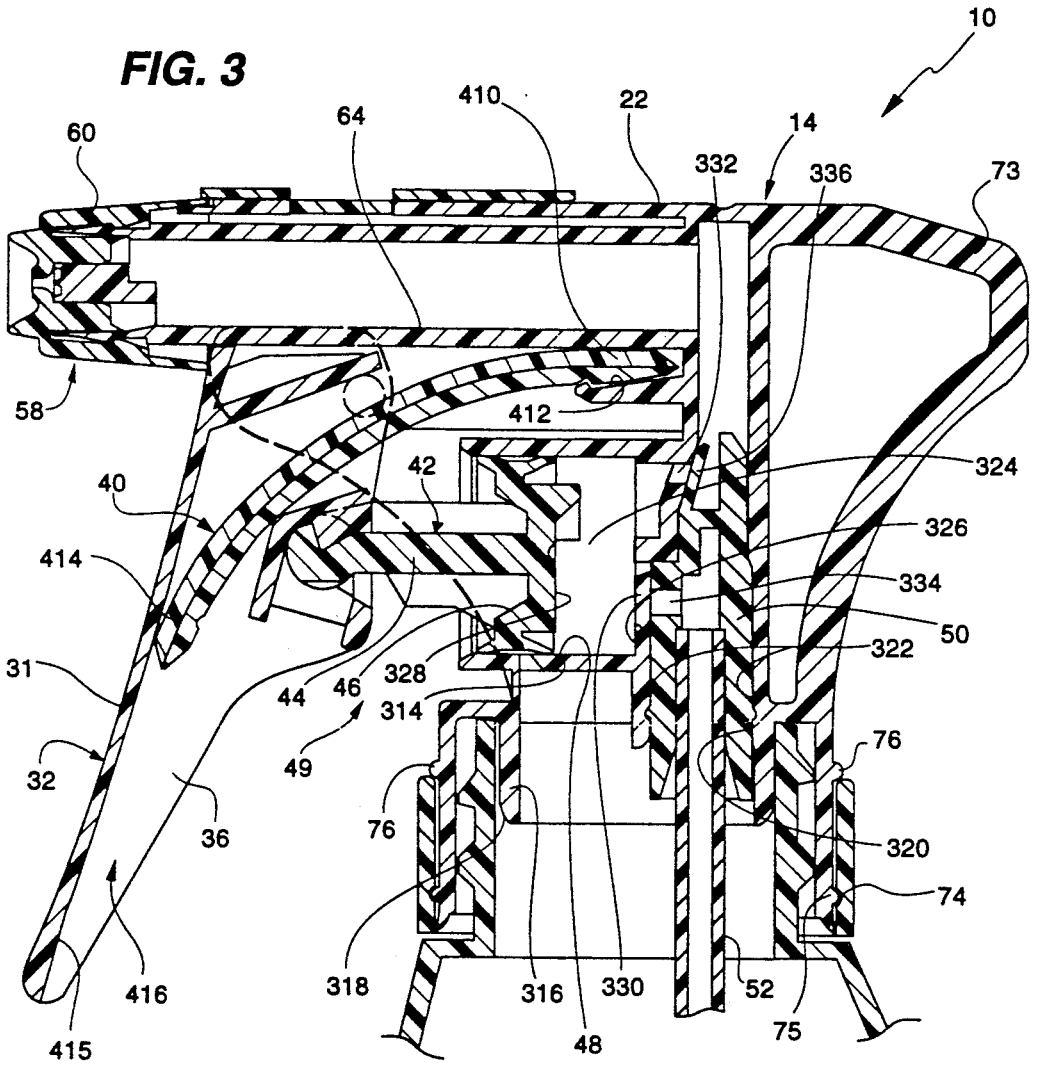
FIG. 3 is a vertical sectional view of the trigger sprayer in its at rest position where a spring between a trigger and the sprayer body biases the trigger and a piston rod coupled thereto to the most outward position.
Figure 4:
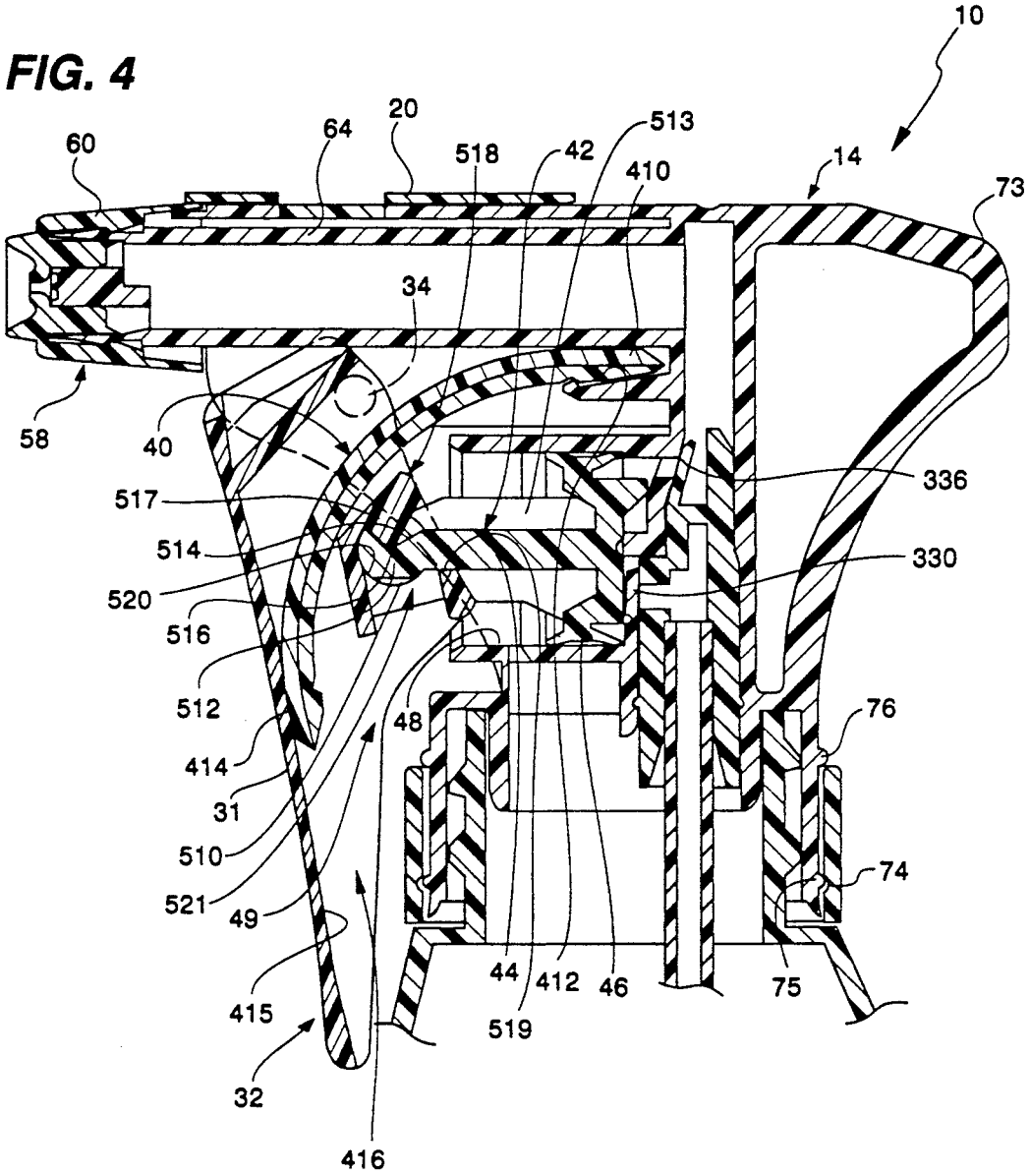
FIG. 4 is a vertical sectional view of the trigger sprayer similar to the view shown in FIG. 1 but showing the trigger fully depressed.
Figure 5:
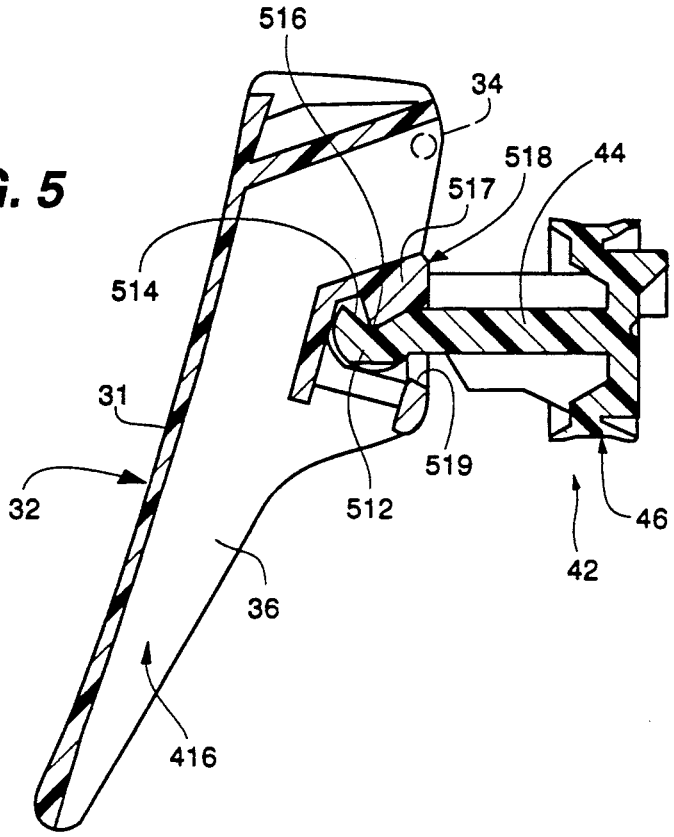
FIG. 5 is a vertical sectional view of the trigger and the piston connected to each other in the home or at rest position.
Figure 6:
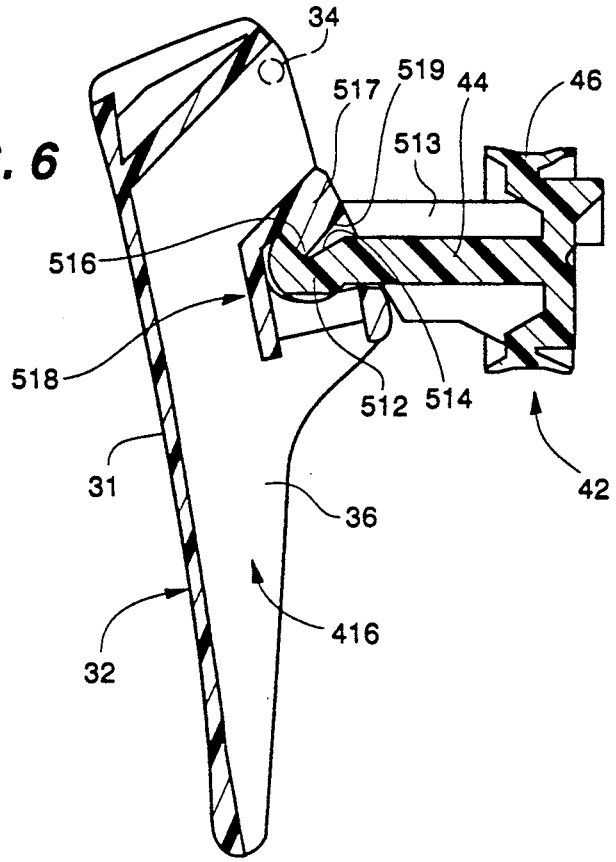
FIG. 6 is a vertical sectional view of the trigger and the piston of FIG. 5 in a fully depressed position.
Figure 7:
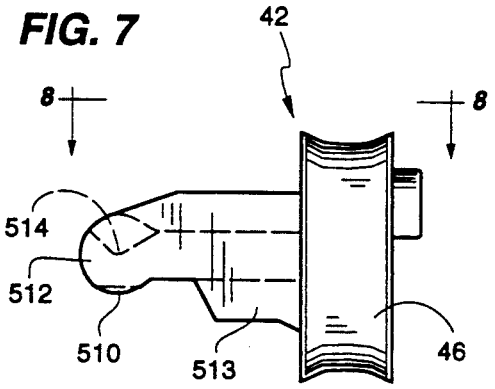
FIG. 7 is a side elevated view of the piston shown in FIG. 4.
Figure 9:
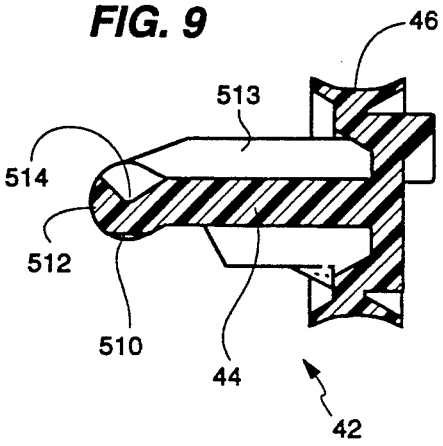
FIG. 9 is a vertical sectional view of the piston shown in FIG. 8 and is taken along line 9—9 of FIG. 8.
Figure 8:
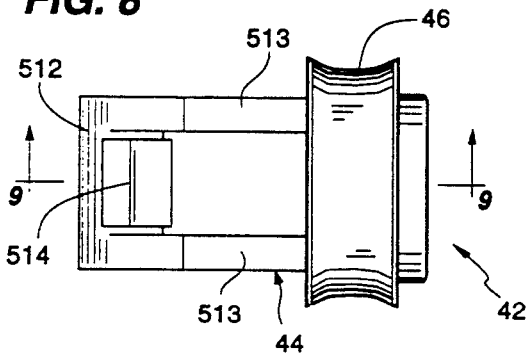
FIG. 8 is a top view of the piston shown in FIG. 7 and is taken along line 8—8 of FIG. 7.
Figure 10:
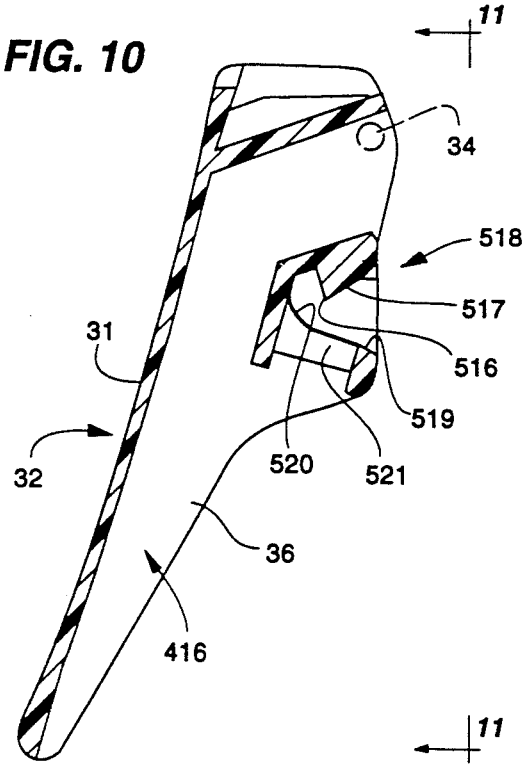
FIG. 10 is a vertical sectional view of the trigger alone.
Figure 11:
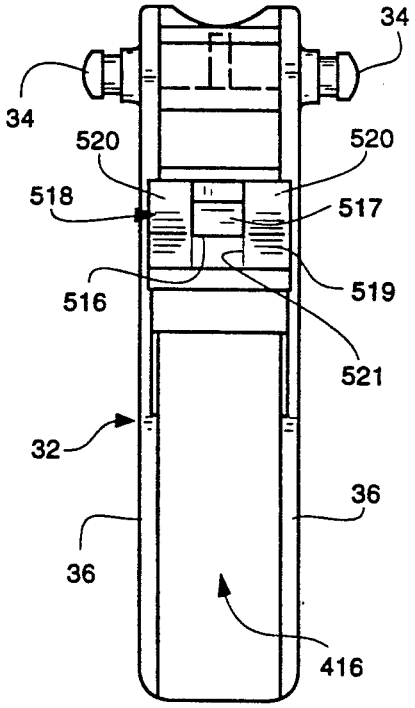
FIG. 11 is a vertical elevational view of the trigger shown in FIG. 10 and is taken along line 11—11 of FIG. 10.

As shown in FIG. 3, molded within the cylindrical base 26 to a top wall 314 of the cylindrical base 26 is a small diameter seal ring 316. The seal ring 316 is designed to seal against the inner diameter of the bottle neck 30. The seal ring 316 has a bevelled end 318 at its lower side to facilitate insertion of the bottle neck 30 into the base 26 and around the seal ring 316.

Within the inner area of seal ring 316 is an opening 320, having a shape according to the shape of the intake stem 50 which is generally oval in cross-section. The intake stem 50 is press-fitted into the opening 320 until ridges 322 on the intake stem 50 snap into mating mounting grooves on the inner surface of the wall of the opening 320. In this way, an air tight seal is provided. The dip tube 52 is releasably fixed in the center of the intake stem 50. The length of the dip tube 52 depends on the size of the bottle 12. However, it is recommended that the dip tube 52 should extend to the bottom of the bottle 12 but shouldn't touch it.

The cylindrical opening 48 is located inside the body 14 of the trigger sprayer 10. The piston cylindrical end 46 fits tightly into the cylindrical opening 48 to create a pumping chamber 324 having a variable volume between a fixed back wall 326 of the cylindrical opening 48 and a rearwardly facing wall 328 of the piston cylindrical end 46. The fixed wall 326 of the pumping chamber 324 has an inlet flap valve 330 situated in the lower part thereof and an opening 332 in the upper part thereof. An orifice 334 through a wall of the intake stem 50 is located to mate or register with the inlet flap valve 330 and to establish an inlet passageway. The inlet passageway is provided by the hollow dip tube 52, the intake stem 50 and the orifice 334.

The opening 332 is located to mate or register with an outlet flap valve 336 on the top side of intake stem 50. Inlet flap valve 330 and outlet flap valve 336 control the fluid flow into and out of pumping chamber 324.

The trigger 32 is pivotally mounted on the body 14 of the trigger sprayer 10 by inserting the two laterally extending pins 34 on the upper part of the trigger 32 into the two corresponding holes 38 in the body 14. The plastic spring assembly 40 has a flat tapered end 410 press-fitted into a recess 412 in the body 14 located underneath an inner end of the cylindrical portion 64 of the body 14. Another end 414 of the plastic spring assembly 40 is placed in a trough-like space 416 in the back side of the trigger 32 against a back wall 415. The plastic spring assembly 40 is bent and remains under stress to urge the trigger 32 always back into its home position.

The piston rod 44 of the piston 42 is pivotally connected to the trigger 32.

As shown in FIGS. 4–11, an outer end 510 of the piston rod 44 has a transversely located cylinder 512. The cylinder 512 is located transversely to the longitudinal axis of the piston rod 44 between legs 513 and has an axially extending V in cross section slot 514 in the middle thereof for receiving a pivot edge 516 at the vertex of a V in-cross-section outer end of a hook member 517 extending between the sides 36 of the trigger 32. The hook member 517 is part of a bearing formation 518 which is provided on the backside of trigger 32 between the sides 36 and which has an opening 519 (FIG. 11) through which the outer end 510 is received. The cylinder 512 engages in the bearing formation 518 of the trigger 32 and the sides of the V shaped slot 514 act as (or form) stops to limit the rotational freedom of the connected parts. The arc subtended by or the angle at the vertex of the "V" of the V shaped slot 514 is substantially greater than the arc subtended by or the angle at the vertex of the "V" of the V in-cross-section outer end of the hook member 517 to permit the V-shaped fulcrum end portion to rotate on the V-shaped pivot seat during movement of the trigger from its home position to its fully squeezed in position. The bearing formation 518, in combination with the V shaped slot 514, establish a movable trigger 32 - piston 42 connection with limited, but sufficient, rotational freedom. This enables the piston 42 to be moved within the pumping chamber 324 while being pivotally connected to trigger 32 in a simple and efficient manner.

The bearing formation 518 includes two rounded bearing seating surfaces 520 adjacent the inner side of each side 36 of the trigger 32 and between one side 36 of the trigger 32 and the hook member 517 at the top of the opening 519 and between one side 36 and a slot 521 on the bottom of the opening 519. The cylindrical ends of the cylinder 512 seat and rotate on these bearing surfaces 520.

From the foregoing description, it will be apparent that the trigger-piston coupling of the trigger sprayer described herein has a number of advantages, some of which have been described above and others of which are inherent in the invention. Also, modifications can be made to the trigger 0 sprayer of the present invention without departing from the teachings of the invention. Accordingly, the invention is only to be limited as necessitated by the accompanying claims.

We claim:

1. A trigger operated pumping mechanism for a fluid dispensing device comprising a body, said pumping mechanism comprising:

a cylinder in the body of the dispensing device;

a piston received in the cylinder and having a piston rod extending outwardly therefrom to an outer end;

a trigger pivotally mounted to the body and having a front side and a back side;

first coupling means on said outer end of said piston rod for coupling to said trigger;

said first coupling means comprising a short cylinder at and extending transversely of said outer end of said piston rod;

said short cylinder having a V-shaped notch in, and extending axially of, said short cylinder;

second coupling means on said back side of said trigger for coupling to said first coupling means on said piston rod;

said second coupling means comprising a bearing formation provided in said back side of said trigger;

said bearing formation including spaced apart, partially cylindrical bearing seats for receiving end portions of said short cylinder and a hook member being positioned to extend into said V-shaped notch;

said hook member having a V in-cross-section outer end for being received in said V-shaped notch; and means for biasing said trigger away from said body.

2. The pumping mechanism of claim 1 wherein a vertex of the V-shaped notch defines a pivot seat and a vertex of the V-shaped formation at the end of said hook member defines a fulcrum.

3. The pumping mechanism of claim 2 wherein said V-shaped notch has an arc sufficiently larger than an arc of said V in cross section outer end of said hook member so as to permit the fulcrum to rotate on the pivot seat during movement of the trigger from its home position to its fully squeezed in position.

4. A trigger operated pumping mechanism for a fluid dispensing device comprising a body, said pumping mechanism comprising:

a cylinder in the body of the dispensing device;

a piston received in the cylinder and having a piston rod formation extending outwardly therefrom to an outer end;

a trigger movably mounted to the body and having a front side and a back side;

first coupling means on said outer end of said piston rod formation for coupling to said trigger comprising a transversely extending short cylinder having engaging means in the middle area thereof;

second coupling means on said back side of said trigger for releasably coupling to said first coupling means on said piston rod formation in a snap-fitting manner, said second coupling means comprising a bearing formation in said back side of said trigger for receiving and engaging said short cylinder and connecting means for snap-fittingly engaging with said engaging means in the middle area of said short cylinder; and means, outside of the cylinder, for biasing said trigger away from said body.

5. The pumping mechanism of claim 4 wherein said short cylinder has a V-shaped notch in, and extends axially of, said short cylinder, said V-shaped notch defining said engaging means, and said connecting means of second coupling means comprises a hook member positioned to extend into said V-shaped notch and having a V in-cross-section outer end for being received in said V-shaped notch.

6. The pumping mechanism of claim 5 wherein a vertex of the V-shaped notch defines a pivot seat and a vertex of the V-shaped formation at the end of said hook member defines a fulcrum.

7. The pumping mechanism of claim 5 wherein said V-shaped notch has an angle at the vertex of the V sufficiently larger than the angle of the vertex of the V of said V in-cross-section outer end of said hook member to permit the V-shaped fulcrum end portion to rotate on the V-shaped pivot seat during movement of the trigger from its home position to its fully squeezed in position.

8. The pumping mechanism of claim 4 wherein said bearing formation includes spaced apart, partially cylindrical bearing seats for receiving end portions of said short cylinder.

* * * * *